US006595592B1

(12) United States Patent
Wieland et al.

(10) Patent No.: US 6,595,592 B1
(45) Date of Patent: Jul. 22, 2003

(54) ARTICLE OF FURNITURE

(75) Inventors: Roy Wieland, Fort Wayne, IN (US); Joel Alberda, Leo, IN (US); Donald Newfer, Auburn, IN (US)

(73) Assignee: Wieland Furniture Company, Inc., Grahill, IN (US)

( * ) Notice: Subject to any disclaimer, the term of this patent is extended or adjusted under 35 U.S.C. 154(b) by 0 days.

(21) Appl. No.: 10/069,331

(22) PCT Filed: Aug. 18, 2000

(86) PCT No.: PCT/US00/22901

§ 371 (c)(1),
(2), (4) Date: Jul. 17, 2002

(87) PCT Pub. No.: WO01/13766

PCT Pub. Date: Mar. 1, 2001

Related U.S. Application Data

(60) Provisional application No. 60/150,301, filed on Aug. 23, 1999.

(51) Int. Cl.[7] ..... A47C 4/02

(52) U.S. Cl. ..... 297/440.23; 297/440.15

(58) Field of Search ..... 297/440.1, 440.15, 297/440.23, 440.22, 440.16

(56) References Cited

U.S. PATENT DOCUMENTS

| | | | | | |
|---|---|---|---|---|---|
| 2,620,024 | A | | 12/1952 | Rietman | |
| 3,030,146 | A | * | 4/1962 | Faxon | 297/440.23 |
| 3,669,495 | A | * | 6/1972 | Von Rudgisch | 297/440.23 |
| 3,774,966 | A | | 11/1973 | Faulkner et al. | |
| 3,973,800 | A | | 8/1976 | Kogan | |
| 5,080,438 | A | * | 1/1992 | Takahashi et al. | 297/440.23 |
| 5,263,764 | A | | 11/1993 | Laughlin et al. | |

FOREIGN PATENT DOCUMENTS

| | | |
|---|---|---|
| GB | 001222070 A | 2/1971 |

* cited by examiner

*Primary Examiner*—Peter R. Brown
(74) *Attorney, Agent, or Firm*—Baker & Daniels

(57) ABSTRACT

An article of furniture, viz., a chair, for institutional use such as in hospital waiting areas, school dormitories, military homes and the like. The chair includes two arms, a front member disposed between the arms, a seat back, a seat deck and a seat cushion. The arms are secured to the front member by screws that threadingly engage apertures therein. The seat back includes protrusions that are captured by a bracket disposed on each chair arm. Screws extend through apertures in both sides of the seat back and into threaded apertures in both arms, thereby fixing the seat back to the arms. The seat deck rests on a ledge in the seat back, secures to a flange on the front member by a screw and supports the seat cushion. The chair is upholstered with fabric having hook and loop strips around the perimeter that corresponds to hook and loop strips on each chair piece.

7 Claims, 3 Drawing Sheets

ARTICLE OF FURNITURE

BACKGROUND OF THE INVENTION

1. Field of the Invention

The present invention relates to an article of furniture for institutional use such as in hospitals, school dormitories, and government housing where such furniture may be placed in waiting areas, public lounges, patient rooms or military homes.

2. Description of the Related Art

Hospital waiting rooms and public lounges, for example must provide seating to accommodate the many people who occupy such areas. Often, such seating areas are furnished with chairs that are not necessarily as strong comfortable or durable as desired. Undesirably, if a chair is damaged the chair must be sent to a facility to be repaired or replaced completely.

Furniture in military housing is typically supplied by the government so that servicemen and women do not have the burden of frequently moving their furniture from place to place, as it is not uncommon for a military family to move as often as every three to four months. Due to the number of people using the furniture provided by the government in such housing, the furniture is used and sometimes worn, thereby creating an environment for military families which is perceived as substandard, or even unwelcome.

A more comfortable, durable and repairable article of furniture for use in institutional markets is desired.

SUMMARY OF THE INVENTION

The present invention provides an article of furniture, viz. a chair, for institutional use such as in hospital waiting rooms, school dormitories, military housing and the like. The chair has six parts which are easy to assemble and upholster, the upholstery material being attached to each part by hook and loop complimentary fasteners. The chairs are durable, comfortable, repairable in the field and reconditioned to a "like-new" appearance by simply changing the upholstery.

The chair of the present invention includes two arms, a front member disposed between the arms, a seat back and a seat deck which supports a seat cushion. The arms are fixed to the front member by bolts while a pair of brackets, one on each arm, receives the back of the chair. The seat deck is supported by and secured to the front member and the seat back. The chair is upholstered with material that is secured to each part by hook and loop, thus making the chair easy to reupholster and the fabric easy to clean.

In one form thereof, a chair is provided, including a front member, including a top surface, and a pair of first apertures adapted to receive fasteners; a pair of arm members, each of the arm members including a first flange having a pair of second apertures adapted to receive the fasteners, a U-shaped bracket secured thereto, and a plate having a third aperture therein adapted to receive a fastener; a seat back member, including first and second sides, each having a protrusion extending therefrom: the protrusion received within the U-shaped brackets, and a fourth aperture adapted to receive a fastener, and a lower edge having the ledge extending thereacross; a seat back, including first and second U-shaped members connected to a lower edge thereof, the first and second U-shaped members defining flange portions at first and second ends of the seat back, the flange portions abutting the ledge of the seat back member and the top surface of the front member; a seat cushion; a plurality of removable upholstery covers, the upholstery covers selectively disposed on the front member, the arm members, the seat back member, and the seat cushion; and a plurality of fasteners extending respectively through the first and second apertures to connect the front portion with the arm members, and through the third and fourth apertures to connect the arm members and the seat back portion.

The advantages of the present invention include lower costs because the chair includes an economy of parts and ease of assembly, which in turn provide lower cost to customers. The chair is lightweight, strong and durable and provides comfortable seating in high-use areas. The chair is reconditioned to a "like-new" appearance by removing worn fabric and upholstering the chair with new pieces of fabric, attaching the fabric thereto by hook and loop, thereby creating a welcome and aesthetically pleasing environment.

BRIEF DESCRIPTION OF THE DRAWINGS

The above mentioned and other features and objects of this invention, and the mariner of attaining them, will become more apparent and the invention itself will be better understood by reference to the following description of an embodiment of the invention taken in conjunction with the accompanying drawings, wherein.

Figure 1:
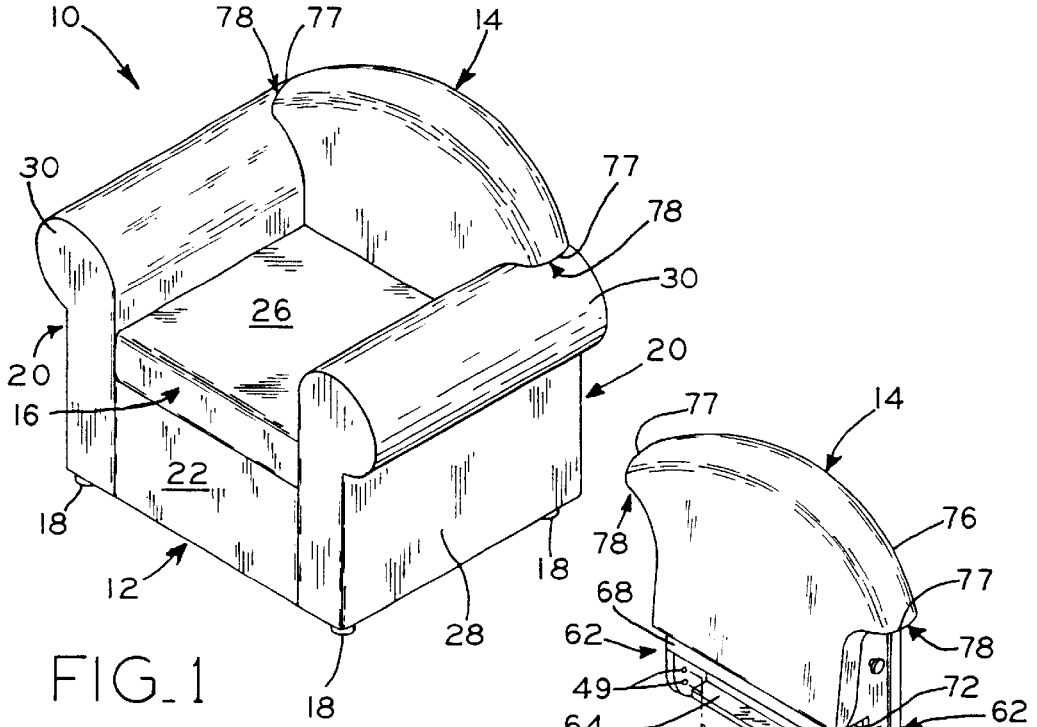
FIG. 1 is a perspective view of a chair which embodies the present invention.

Corresponding reference characters indicate corresponding parts throughout the several views. Although the drawings represent embodiments of the present invention, the drawings are not necessarily to scale and certain features may be exaggerated in order to better illustrate and explain the present invention.

DETAILED DESCRIPTION

Figure 2:
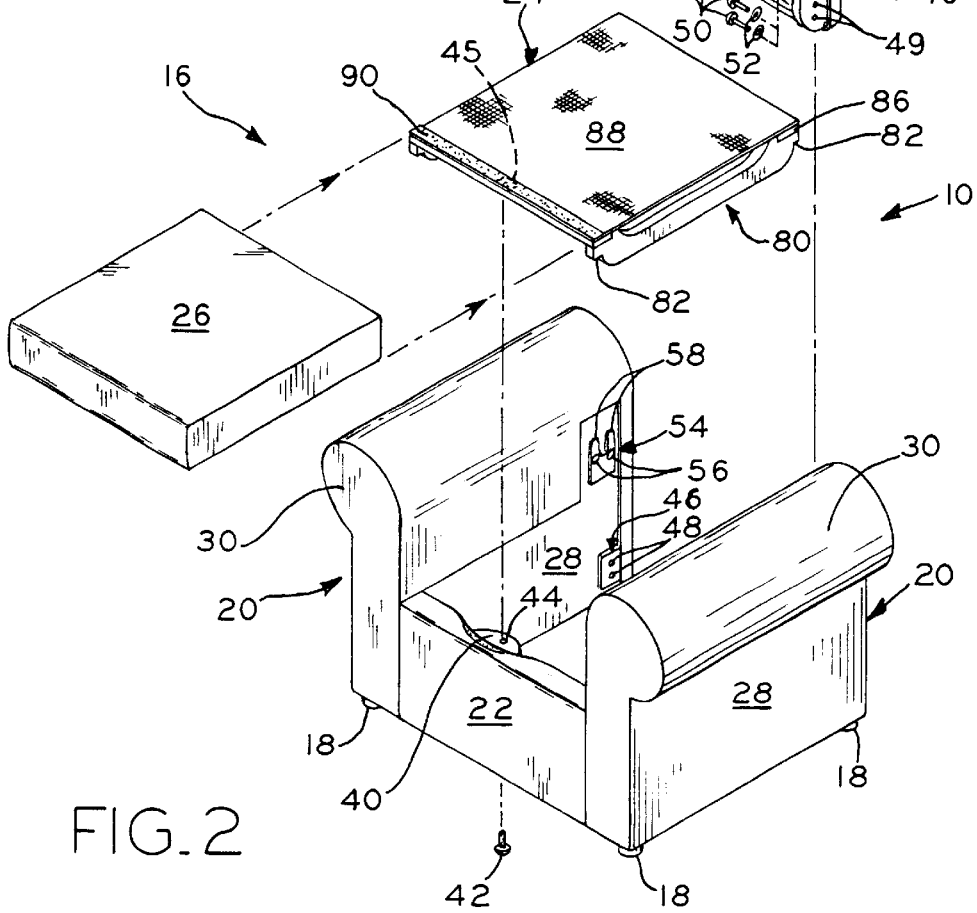
FIG. 2 is a perspective view of the chair of FIG. 1 showing the seat cushion, seat deck and seat back exploded from the base.
Figure 3:
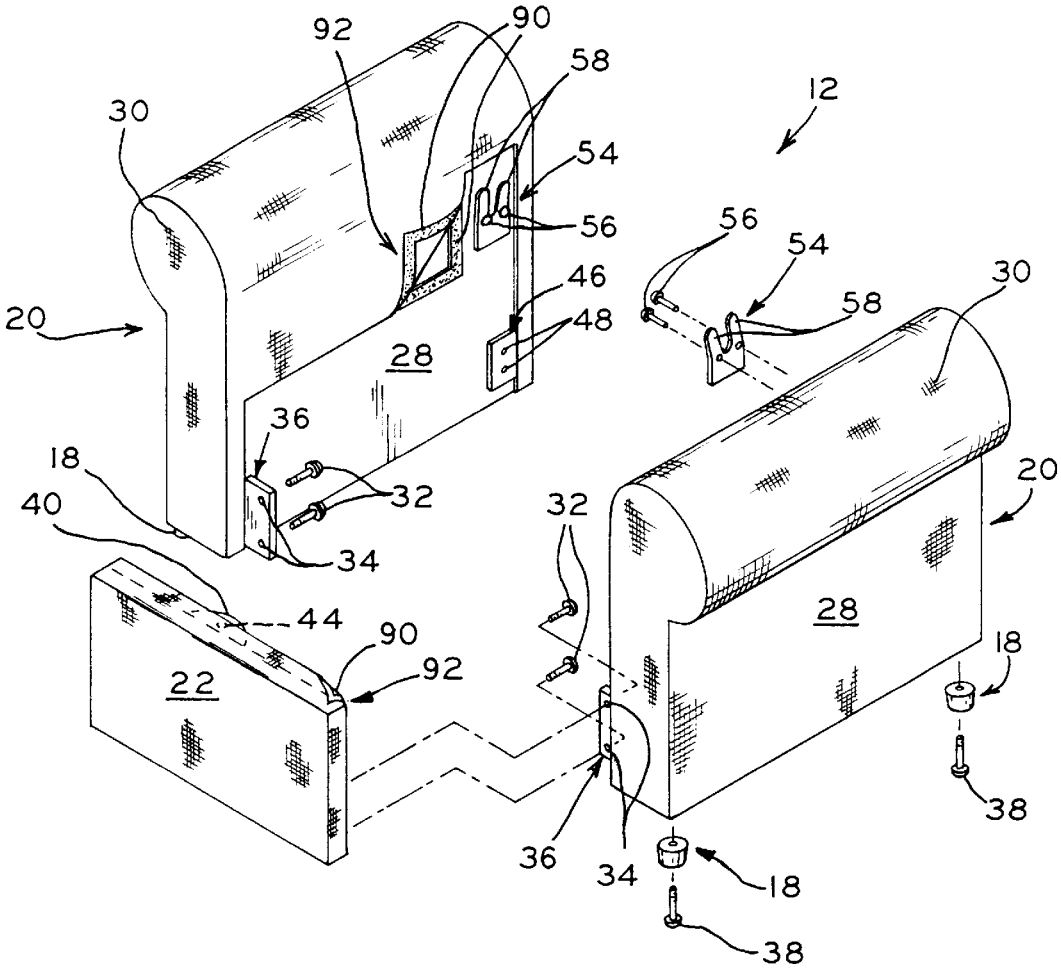
FIG. 3 is an exploded view of the base portion of FIG. 2.

Referring to FIGS. 1 and 2, chair 10 includes base 12, seat back 14, seat 16 and feet 18. As illustrated in FIG. 3, base 12 includes two arms 20 and front member 22. Each arm 20 includes rectangular area 28 and rounded arm rest 30. Rounded arm rest 30 is located along the top edge of rectangular area 28 and extends the length of rectangular area 28. A pair of feet 18 are located on base 12 at the bottom of each end of arm 20 so as to support chair 10. Feet 18 are fixed to arms 20 by screws 38. Front member 22 is secured to arms 20 by four screws 32 which extend through apertures 34 in flanges 36 and threadingly engage apertures (not shown) in front member 22. Flanges 36 are located on the inner side of arms 20 at the lower, front corner and are substantially perpendicular thereto. Semicircular portion 40 extends approximately perpendicular from the top, center of front portion 22 (FIGS. 2 and 3) and is provided to locate, fix and secure seat deck 24 to front portion 22. Screw 42 shown in FIG. 2 extends upwardly through aperture 44 in flange 40 and into corresponding threaded aperture 45 in seat deck 24, thereby fixing seat deck 24 to front portion 22.

Figure 4:
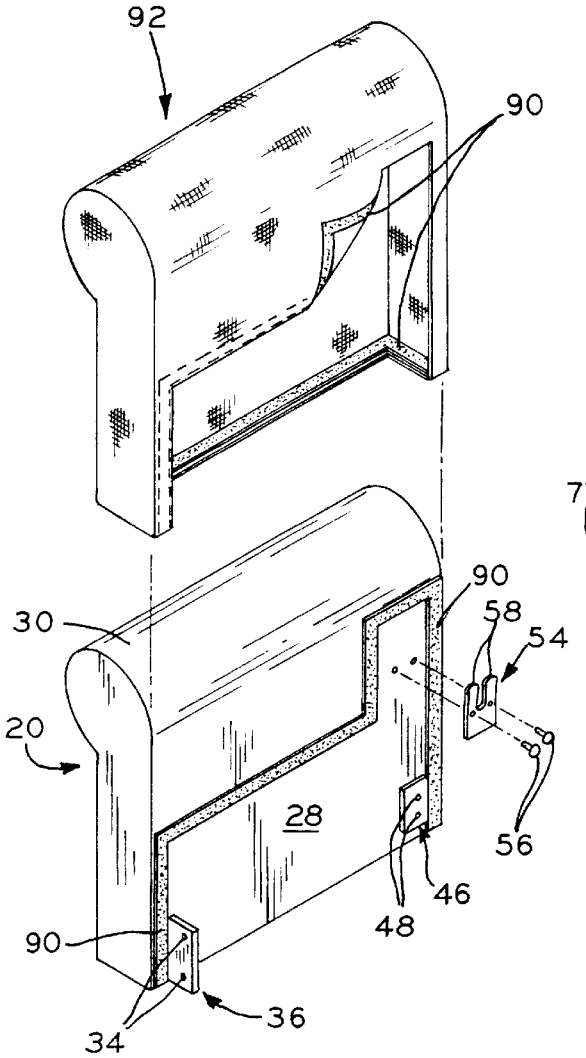
FIG. 4 is a perspective view of an arm of the base portion of FIG. 3 with the brackets and upholstery material exploded therefrom.
Figure 5:
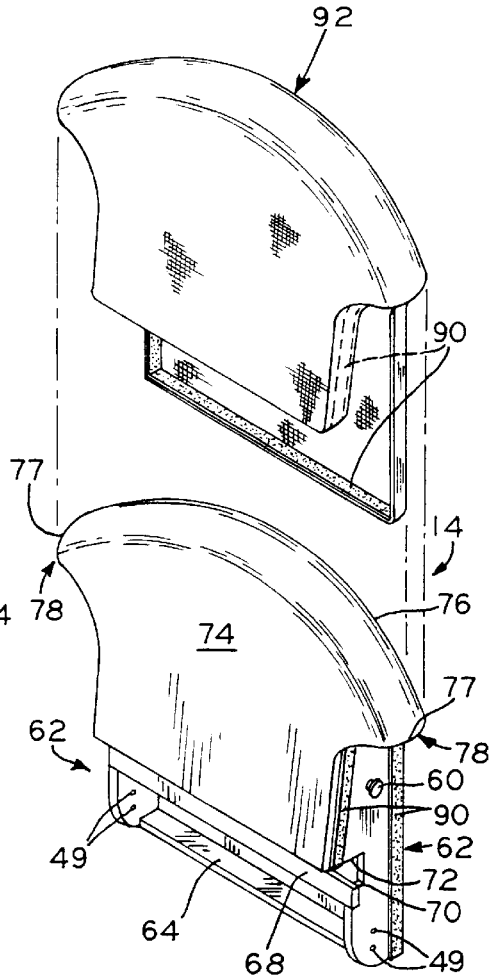
FIG. 5 is a perspective view of the seat back of the chair shown in FIG. 2 with the upholstery material exploded therefrom.

Included on the inner side of arms 20, in the lower, rear corners are plates 46 (FIGS. 2, 3 and 4) provided with apertures 48 that correspond to apertures 49 in the lower portions of side members 62 of seat back 14 (FIGS. 2 and 5). Screws 50 extend from the inside of side members 62, through washers 52, through apertures 49 in seat back 14 and engage threaded apertures 48 in plate 46 on arm 20. Also located along the back edge of arms 20, disposed above flanges 46, are brackets 54 fixed to arms 20 by screws 56 as shown in FIGS. 3 and 4. Brackets 54 are U-shaped with portions 58 bent slightly forward to accept protrusion 60 located on the outside of side members 62 of seat back 14 (FIGS. 2 and 5).

Referring to FIGS. 2 and 5, seat back 14 fits between the back edges of arms 20 such that seat back 14 is substantially parallel to front member 22. Seat back 14 includes side members 62, which carry protrusions 60 disposed above apertures 49, and support beam 64 located below apertures 49. Support beam 68 extends from one side member 62 to the other and along with cutout portion 66, creating ledge 70 upon which seat deck 24 rests. Cutout portion 66 is defined by ledge 70 at the bottom and edge 72 at the top. Edge 72 protrudes past the front edges of side members 62 and provides an attachment point for cushion 74 (FIG. 5). Rounded edge 76 at the top of cushion 74 terminates at points 77 that extend past side members 62 providing portions 78 which fit over the back edge of arm rests 30 (FIG. 1). Protrusions 60 on side members 62 are guided between portions 58 of brackets 54, and apertures 48 in plate 46 on arms 20 align with apertures 49 in side members 62, thereby locating seat back 14 with respect to base 12.

Referring to FIG. 2, seat 16 includes seat deck 24 and seat cushion 26 which rests thereon. Seat deck 24 includes U-shaped support members 80 having flanges 82 located at both ends thereof. Support member 84 is located across the front edge of seat deck 24 while support member 86 is located across the back edge of seat deck 24, both ends of members 84, 86 engaging U-shaped members 80. Support member 84 has aperture 45 therethrough for securing deck 24 to semicircular flange 40 of front portion 22. Front flange 82 rests on top of flanges 36 on arms 20 while rear flange 82 rests on ledge 70 in cutout portion 66 of seat back 14. Mesh material 88 is fastened to support members 84 and 86 providing a deck for seat cushion 26. Hook and loop strip 90 is located along the front, top edge of seat deck 24 and extends the length of member 84. Hook and loop strip 90 along the edge of material 92 on front member 22 (FIG. 3) fastens to hook and loop strip 90 on seat deck 24.

With reference to FIGS. 3, 4 and 5, material 92 used to upholster chair 10 is attached by hook and loop 90 to each piece separately so as to be easily removed for cleaning. As shown in FIG. 3, on front portion 22, material 92 is provided with hook and loop strip 90 that is secured to strip 90 on seat deck 24. As shown in FIGS. 4 and 5, material 92 has hook and loop strips 90 around its perimeter corresponding to hook and loop strips 90 on arms 20 and seat back 14. When a new family moves into military housing for example, material 92 is removed from chair 10, cleaned and stored. A clean set of material 92 is taken from storage and used to upholster chair 10 providing "newness" to the furniture. The process repeats as families move in-and out of the homes.

In order to assemble chair 10, front portion 22 is first secured to arms 20 at flanges 36 using screws 32. Once base portion 12 is free standing, seat back 14 is placed at the rear of arms 20. Protrusions 60 on side members 62 of seat back 14 are captured by brackets 54 and apertures 48 on arms 20 are aligned to apertures 49 in side member 62 so that screws 50 can fix seat back 14 into place between arms 20, substantially parallel to front 22. Chair 10 is then turned over and the front portion of seat deck 24 having hook and loop strip 90 is placed between arms 20. The rear portion of seat deck 24 is aligned in cut out portion 66 so that flanges 82 rests on ledge 70. The front portion of seat deck 24 is then lowered into place atop semicircular portion 40 and flanges 36. Screw 42 is installed through aperture 44 in portion 40 and aperture 45 in seat deck 24, thereby fixing seat deck 24 to base 12. Seat cushion 26 is placed atop seat deck 24 thus providing the assembled chair 10 shown in FIG. 1.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A chair, comprising:

a front member, including:

a top surface; and a pair of first apertures adapted to receive fasteners;

a pair of arm members, each of said arm members including:

a first flange having a pair of second apertures adapted to receive fasteners;

a U-shaped bracket secured thereto; and a plate having a third aperture adapted to receive a fastener;

a seat back member, including:

first and second sides, each having a protrusion extending therefrom, said protrusions received within said U-shaped brackets, and a fourth aperture adapted to receive a fastener;

a lower edge having a ledge extending thereacross;

a seat deck, including:

first and second U-shaped members connected to a lower edge thereof, said first and second U-shaped members defining flange portions at first and second ends of said seat deck, said flange portions abutting said ledge of said seat back member and said top surface of said front member;

a seat cushion;

a plurality of removable upholstery covers, said upholstery covers selectively disposed on said front member, said arm members, said seat back member, and said seat cushion; and a plurality of fasteners extending respectively through said first and second apertures to connect said front portion with said arm members, and through said third and fourth apertures to connect said arm members and said seat back portion.

2. The chair of claim 1, wherein each of said arm members include a pair of feet, said feet adapted to rest against a ground surface.

3. The chair of claim 1, wherein an upholstery cover disposed on said seat cushion and said seat deck each include a hook and loop strip, said hook and loop strips engaging one another to secure said seat cushion to said seat deck.

4. The chair of claim 1, wherein said front portion includes a horizontal flange having a fifth aperture adapted to receive a fastener and said seat deck includes a sixth aperture adapted to receive a fastener, and a fastener extending through said fifth and sixth aperture to secure said front portion and said seat deck to one another.

5. The chair of claim 1, wherein said seat deck is made of a mesh material.

6. The chair of claim 1, wherein said arm members each include rectangular areas, and rounded arm rest portions disposed above said rectangular areas.

7. The chair of claim 1, wherein each of said upholstery covers and each of said front member, said arm members, said seat back member, and said seat cushion include hook and loop strips, said hook and loop strips of said upholstery covers engaging respective hook and loop strips of said front member, said arm members, said seat back member, and said seat cushion to secure said upholstery covers thereto.

* * * * *